US005122095A

United States Patent [19]

Wolfert

[11] Patent Number: 5,122,095

[45] Date of Patent: Jun. 16, 1992

[54] ADJUSTABLE FILTERED ROOF RIDGE VENTILATOR

[75] Inventor: Clarke K. Wolfert, Peoria, Ill.

[73] Assignee: Air Vent, Inc., Peoria Heights, Ill.

[21] Appl. No.: 664,394

[22] Filed: Mar. 4, 1991

[51] Int. Cl.[5] ..... F24F 7/02

[52] U.S. Cl. ..... 454/365

[58] Field of Search ..... 52/199; 98/42.21

[56] References Cited

U.S. PATENT DOCUMENTS

| | | | |
|---|---|---|---|
| 1,717,728 | 6/1929 | Moore | 98/42.21 |
| 2,214,183 | 9/1940 | Seymour | 98/42.21 |
| 2,799,214 | 7/1957 | Rouse | 98/42.21 |
| 2,868,104 | 1/1959 | Honholt et al. | 98/42.21 |
| 4,280,399 | 7/1981 | Cunning | 98/42.21 |
| 4,325,290 | 4/1982 | Wolfert | 98/42.21 |
| 4,782,743 | 11/1988 | Quinnell | 98/42.21 |
| 4,903,445 | 2/1990 | Mankowski | 98/42.21 X |
| 4,957,037 | 9/1990 | Tubbesing et al. | 98/42.21 |

FOREIGN PATENT DOCUMENTS

| | | | |
|---|---|---|---|
| 2707384 | 8/1978 | Fed. Rep. of Germany | 52/199 |

*Primary Examiner*—Harold Joyce

*Attorney, Agent, or Firm*—Silverman, Cass & Singer Ltd.

[57] ABSTRACT

A roof ridge ventilator to be installed overlying the open ridge and along the length of the roof of a building which is adjustable to accommodate a variety of different roof pitches and directs the flow of air from the interior of the building to the exterior of the building including an elongate top wall member having a predetermined length and width and top and bottom sides, a pair of outer side walls one each integrally formed along the longitudinal length of and depending from a respective bottom side of the top wall member and at a predetermined angle with respect to the top wall member, each of the side walls including a plurality of apertures extending therethrough, a pair of upturned edge members, one each integrally formed with a respective distal end of the outer side walls opposite the top wall member and extending along the longitudinal length of, and at a predetermined angle with respect to, the side walls, the up-turned edge members extending back toward the top wall member a predetermined distance to effectively shield at least a portion of the apertures and a plurality of brace members positioned at predetermined intervals along the length of the bottom side of the top wall member for engagement with a roof surface.

8 Claims, 2 Drawing Sheets

Fig. 1
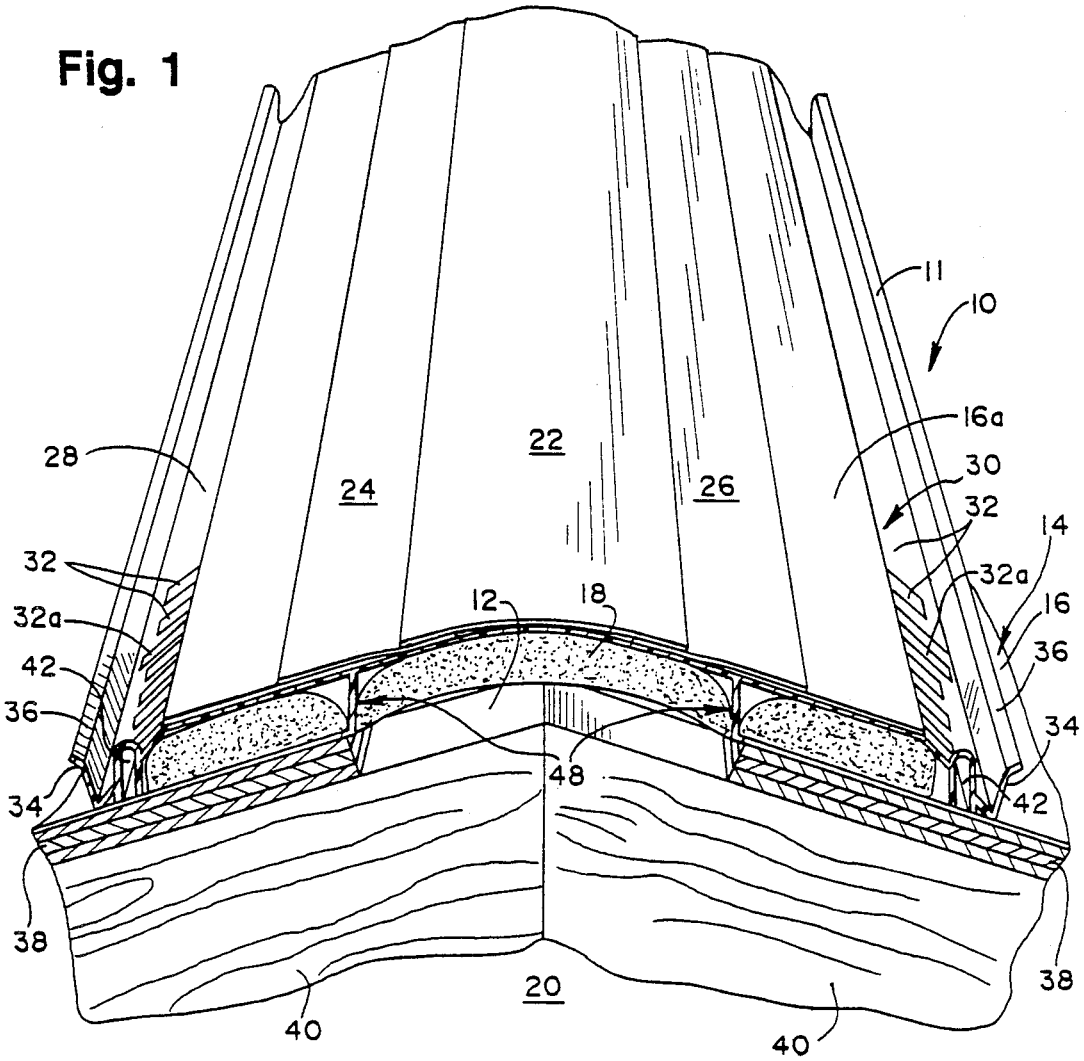
Fig. 2
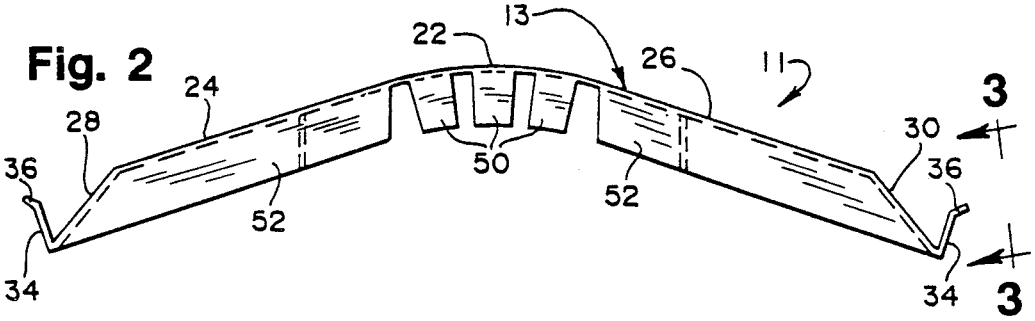
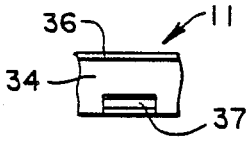
Fig. 3
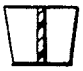
Fig. 4

ADJUSTABLE FILTERED ROOF RIDGE VENTILATOR

FIELD OF THE INVENTION

This invention relates generally to roof ridge ventilators having non-moving parts and more particularly, to a low profile unitary roof ridge ventilator which provides proper venting of the attic of a house, restricts insects and the elements from entering he attic through the ventilator, is adjustable to accommodate a variety of different roof pitches and can be shingled over to match the remaining portion of the roof.

BACKGROUND OF THE INVENTION

Roof ridge ventilators are installed overlying the open roof ridge and along the length of a building for exhausting heated air from the space below the roof of the building, such as he attic of a house or small commercial/industrial building or the like. These ventilators typically are installed in cooperation with ventilators positioned in the soffits of the building roof to provide a ventilation system in which air is exhausted from the attic through the roof ridge ventilator and is replenished through the soffit ventilators.

In an optimum roof ridge soffit ventilator system, there is a balance between the net free open area presented by both the roof ridge and soffit ventilators. The phrase "net free open area of a ventilator" is intended to mean the cross-sectional area of a ventilator which is open for passage of air therethrough. A balance between the net free open area of a roof ridge and soffit ventilator is difficult to obtain. In many new homes there is a lack of sufficient soffit area in which to provide the soffit ventilators while many existing homes do not have sufficient existing soffit ventilation to provide the balanced system. Thus, in many new and existing homes there is an occurrence of an out of balance roof ridge/soffit ventilation system.

These out-of-balance ventilation systems are subject to several problems, one of which is the infiltration of moisture through the ventilators. An out of balance system favoring the soffit vents will produce a weak ventilation system but little harm will occur from infiltration of moisture through the roof ridge or soffit ventilators into the space below the roof of the building. In an out of balance system favoring the roof ridge ventilators, however, a phenomenon occurs in response to normal winter winds that will infiltrate moisture such as snow through the roof ridge ventilator. This infiltration of moisture phenomenon is described in detail and is solved, for example, in U.S. Pat. No. 4,325,290 which is assigned to the assignee of the present invention and hereby is incorporated by reference.

This type of existing ventilator system restricts infiltration of moisture by providing a high impedance to moisture while presenting a low impedance for air passing through the ventilator. Such ventilators typically are formed from aluminum, rolled sheet zinc or like material with a high profile. Thus, they may be somewhat difficult to handle and install, cannot readily be adjusted to accommodate different roof pitches, and cannot be shingled over which, when combined with its high profile, tends to be unsightly on the roof of a house.

Recent studies also have indicated that a free flow of air within a structure tends to affect infestation of insects, such as cockroaches. Such insects tend to accumulate in enclosed, dark spaces where there is little or no air movement, such as attics, soffits and overhangs on houses and smaller commercial and industrial buildings. Moving air apparently bothers the hair and/or antennae on their bodies causing these insects to seek out an enclosed dark space. Thus, a free flow of air within a structure combined with appropriate filter members utilized with the roof ridge and soffit ventilators, can provide an effective means of pest control.

The roof ridge ventilator of the present invention provides a low profile, unitary ventilator that establishes proper air flow through the attic, restricts insects and the elements from entering through the ventilator, can be adjusted on sight to accommodate a variety of roof pitches and openings and can be shingled over to match the shingles of the remaining portion of the roof.

SUMMARY OF THE INVENTION

A roof ridge ventilator is disclosed which is to be installed overlying the open ridge and along the length of the roof of a building, is adjustable to accommodate a variety of different roof pitches and directs the flow of air from the interior of the building to the exterior of the building. The ventilator includes an elongate top wall member having a predetermined length and width and top and bottom sides. A pair of outer side walls are included, each of which are integrally formed along the longitudinal length of and depend from a respective side of the top wall member and at a predetermined angle with respect to the top wall member where each of the side walls includes a plurality of apertures extending therethrough. A pair of upturned edge members also are included, one each integrally formed with a respective distal end of the outer side walls opposite the top wall member and extend along the longitudinal length of, and at a predetermined angle with respect to, the side walls where the upturned edge members extend back toward the top wall member a predetermined distance to effectively shield at least a portion of the apertures. A plurality of brace members are included positioned at predetermined intervals along the bottom side of the top wall member for engagement with a roof surface.

BRIEF DESCRIPTION OF THE DRAWINGS

FIG. 1 is a perspective view of a length of a roof ridge ventilator assembly of the invention, including an elongate ventilator member and accompanying filter medium, mounted on a section of a building roof;

FIG. 2 is an end elevational view of the ventilator member of FIG. 1 without the filter medium and detached from the building roof;

FIG. 3 is a fragmentary side elevational view taken along the line 3—3 of FIG. 2 in the direction indicated generally, illustrating a weep hole of the ventilator member;

FIG. 4 is a fragmentary cross-sectional view taken along the line 4—4 of FIG. 5 in the direction indicated generally illustrating a brace member of the ventilator.

DESCRIPTION OF THE PREFERRED EMBODIMENTS

Figure 5:
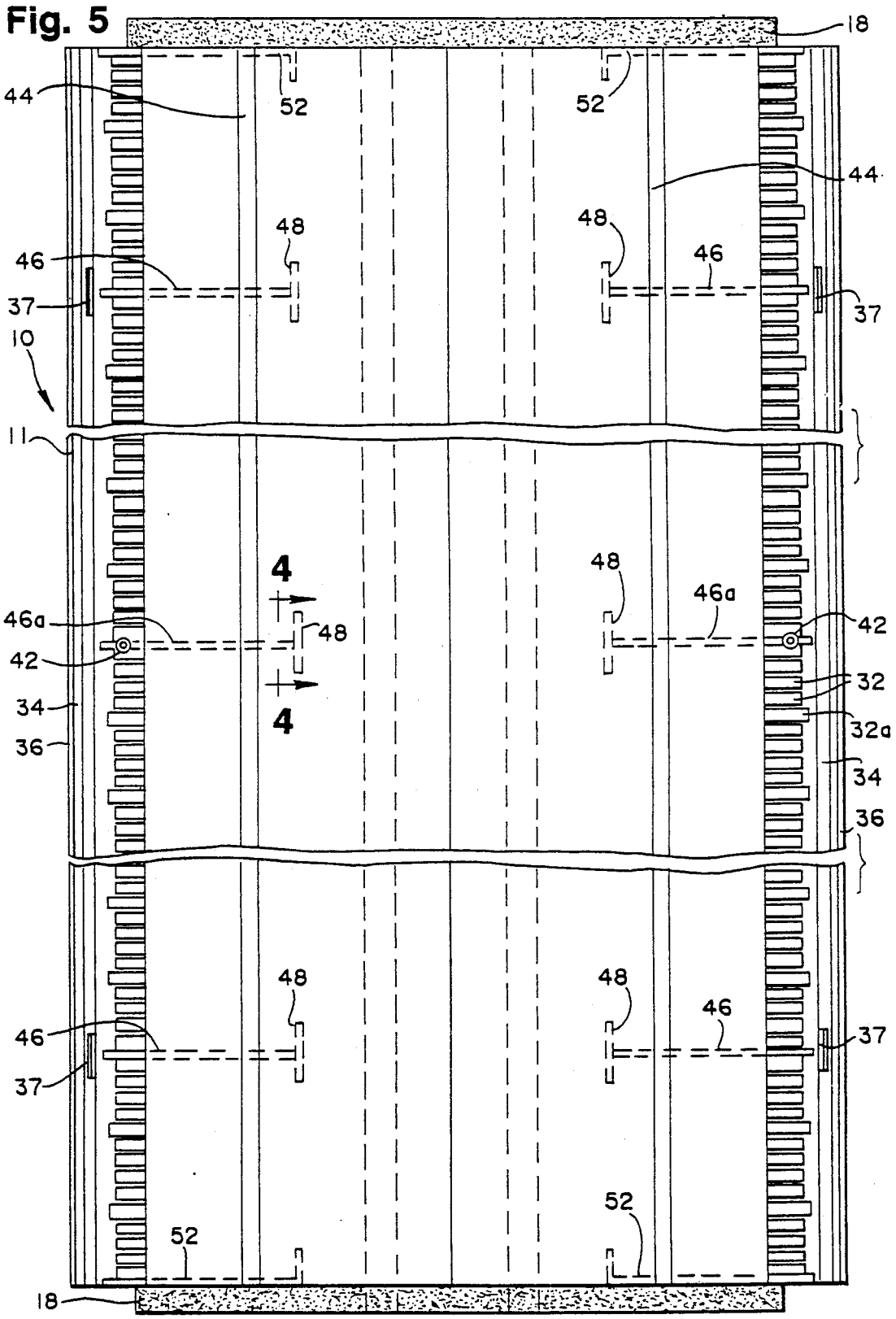
FIG. 5 is a fragmentary top view of the ventilator positioned over a filter medium of the invention with the brace members illustrated in dotted outline.

Referring to FIG. 1, a roof ridge ventilator assembly embodying the invention generally is designated by the reference numeral 10. The ventilator assembly 10 is described in connection with a roof ridge and soffit ventilation system in which a roof ridge ventilator assembly, such as the ventilator assembly 10, is installed overlying an open ridge 12 of a building roof 14 which typically includes shingles 16. It is to be understood, however, that the ventilator assembly 10 can be used in a variety of other roofing or similar ventilation applications, if desired.

The ventilator assembly 10 includes a ventilator member 11 which generally is formed as a unitary elongate member which is connected to the roof 14 and runs along the length of the open ridge 12. Preferably, the ventilator member 11 is utilized with a filter medium 18, such as a porous, nonwoven, resilient fiberglass material or the like, which is positioned between the ventilator member 11 and the roof 14 as will be described in detail below.

Additionally, the ventilator member 11 preferably is shingled over with cap shingles 16*a* which match the shingles 16 on the remainder of the roof 14. Thus, the low profile of the ventilator assembly 10 combined with the cap shingles 16*a* enables the ventilator assembly 10 to blend with the roof line to provide an aesthetically pleasing appearance.

Briefly, in operation, a flow of air is established in the space beneath the roof 14, such as an attic 20 of a typical house. The ventilator assembly 10 enables heated air which rises within the attic 20 and through the open ridge 12 to escape through the ventilator assembly 10 to the exterior of the roof 14 while restricting the elements or insects from entering into the attic 20 through the ventilator assembly 10. The escaping heated air from the attic 20 typically is replenished with outside air through soffit vents (not illustrated) installed within the soffit of the roof 14 or from any other air inlet source.

As FIGS. 1, 2, and 5 illustrate, the ventilator member 11 preferably is integrally formed from a single sheet of flexible plastic or the like to a predetermined length and width. The ventilator member 11 is slightly bowed along its longitudinal center line with the concave side of the ventilator member 11 facing the open ridge 12 thereby essentially forming mirror image left and right halves. Thus, as FIG. 2 illustrates, the ventilator member 11 includes a top wall member in which roughly is broken into three segments: a center bowed portion 22 and first and second substantially identical planar portions 24 and 26 formed on opposite sides of the center bowed portion 22. Each of the portions 22, 24 and 26 span the entire longitudinal length of the ventilator member 11 and can vary in thickness and width as desired.

Accordingly, the ventilator member 11 has a slight U-shaped cross-sectional configuration where the planes containing the first and second planar portions 24 and 26 intersect at a position above the center bowed portion 22 with respect to FIG. 2. Thus, due to the bowed shape and flexible plastic material of the ventilator member 11, the ventilator member 11 readily can be positioned and adjusted by bending it along its length to overly a range of different roof ridges 12 which are formed with different pitches of the roof 14.

Additionally, to assist in flexing the ventilator member 11, the ventilator 11 can be scored to provide one or more living hinges (not illustrated). The living hinges can be integrally formed with the ventilator member 11, positioned between the bowed portion 22 and respective first and second planar portions 24 and 26 and run the entire length of the ventilator member 11 or any portion thereof.

As FIG. 2 illustrates, the sides of each of said first and second planar portions 24 and 26 opposite the bowed portion 22 include a respective first and second outer side walls 28 and 30 which depend at a slight angle therefrom. As FIGS. 1 and 5 illustrate, to provide venting of air from the attic 20 through the ventilator assembly 10 to ambient atmosphere, the side walls 28 and 30 include a plurality of apertures or slots 32 extending therethrough and positioned along the longitudinal length of the side walls 28 and 30. The slots 32 extend substantially perpendicular to the longitudinal center line of the ventilator member 11 and can be of the same or varying lengths. Preferably, as FIG. 5 illustrates, alternating fifth and ninth slots 32*a* are formed slightly longer than the remaining slots 32 in order to stagger the air flow and enhance the structural integrity of the ventilator member 11. The spacing and length of the slots 32 and 32*a* can vary. Preferably the slots 32 have a length of 1.0625" (2.70 cm) and the slots 32*a* have a length of 1.1875" (3.01 cm). Both slots 32 and 32*a* have the same width of 0.200" (0.51 cm) and a spacing of 0.085" (0.22 cm).

As FIGS. 1, 2 and 5 illustrate, in order to partially shield and provide a low pressure area in the vicinity thereof to thereby enhance exhaustion of air through the slots 32 and 32*a*, the side walls 28 and 30 include an integrally formed upturned edge or baffle member 34 which is selectively spaced from the side walls 28 and 30 to provide the desired low pressure area. The baffle members 34 are formed extending at an upward angle back toward the respective first and second planar portions 24 and 26 and include an outwardly extending lip 36.

As FIGS. 3 and 5 illustrate, in order to prevent water from building up between the side walls 28 and 30 and their respective baffle members 34, a plurality of drain apertures or weep holes 37 can be formed through the ventilator member 11 proximate the interface between each side wall 28 and 30 and its respective baffle member 34. The size, spacing and positioning of the weep holes 37 can vary, so long as the desired draining is provided. Preferably, the weep holes 37 are rectangular in shape having a length of ¾" (1.90 cm) and a width of ¼" (0.63 cm) and are spaced 8" (20.32 cm) apart center to center.

As FIG. 1 illustrates, the ventilator assembly 10 is mounted to the building roof 14. The roof 14 typically is formed by roof boards 38, which can be made of plywood or the like, which are covered by the shingles or sheathing 16. The roof boards 38 are carried by rafter members 40 which typically are spaced along the longitudinal length of the roof 14 at intervals (not illustrated).

In order to pre-position and initially secure the ventilator assembly 10 to the roof boards 38, the ventilator member 11 includes an integrally formed bushing or sleeve member 42 positioned on either side of the ventilator member 11 proximate its midpoint through which a fastener, such as a roofing nail (not illustrated) can pass through. Thereafter, to secure shingles 16*a* on top of the ventilator member 11 and/or further secure the ventilator assembly 10 to the roof boards 38, a plurality of nails (not illustrated) can be driven through the ventilator member 11, preferably along a nail line 44, illustrated in FIG. 5, which is embossed on the outer surface of the ventilator member 11 and serves as a guide during installation.

As described above, the ventilator member 11 typically is utilized with the filter medium 18. The filter medium 18 serves to inhibit snow and rain from passing through the ventilator assembly 10 as well as insects, including cockroaches, which tend to migrate into the attic 20, yet enables sufficient air flow therethrough. Preferably, for ease of installation at the job site, the filter medium 18 is adhesively secured to the bottom surface or underside of the ventilator member 11 at one or more locations along the longitudinal center line of the ventilator member 11 to form a single unit. Alternatively, the filter medium 18 can be provided separate from the ventilator member 11 and, during installation, the filter medium 18 can be trapped between the ventilator member 11 when it is nailed to the roof boards 38 as described above.

It is to be noted that air flow passes through the filter medium 18 in a direction substantially transverse, rather than parallel, to the thickness of the filter medium 18. This provides a drop in resistance for the air flow while still inhibiting snow, rain and insects from passing through the filter medium 18.

Additionally, as FIG. 5 illustrates, to resist snow, rain and insect infiltration between consecutively placed ventilator members 11, the length of the filter medium 18 can extend slightly beyond the longitudinal length of the ventilator member 11. This also assists in resisting infiltration as the ventilator members 11 expand and contract with temperature.

As FIGS. 1, 2 and 5 illustrate, in order to strengthen the ventilator member 11, provide spacing and support between the ventilator member 11 and the roof boards 38 and hold the filter medium 18 tight against the roof boards 38, the underside of the ventilator member 11 includes a plurality of integrally formed depending brace wall members or struts 46. The brace walls 46 are positioned at intervals along the bottom longitudinal length of the ventilator member 11, depend a predetermined distance therefrom, and extend laterally from an outer position proximate the baffles 34 inward to a position proximate the midpoint of the respective first and second portions 24 and 26. As FIG. 5 illustrates, the outer end of each brace wall 46 preferably forms a wall between slots 32 in the respective first and second side walls 28 and 30 and the central brace wall **46*a* includes the bushing or sleeve member 42**.

Additionally, the innermost end of each brace wall 46 can include a cross-leg 48, thereby providing the brace walls 46 with a T-shaped cross-sectional configuration. It is to be understood, however, that the size and shape of the brace walls 46 can vary.

The specific design of the ventilator member 11 and brace walls 46 enable the filter medium 18 to be held tight against the roof 16 to inhibit wind from lifting the filter medium 18 when the ventilator assembly 10 is positioned on dimensioned or "architectural" shingles where the low spots have not been caulked. Thus, the filter medium 18, when used with such dimensioned shingles, will act as a seal between the ventilator 11 member and low spots on the dimensioned or "architectural" shingles. Furthermore, the brace walls 46 prevent undesirable compression of the filter medium 18 when ventilator members 11 are nested together during shipping.

As FIG. 2 illustrates, to provide support to the ends of the ventilator member 11 in a manner similar to the brace walls 46, one or more tabs 50 and flanges 52 can be included. The tabs 50 and flanges 52 depend a predetermined distance from the underside of the ventilator member 11 to continue the spacing of the ventilator member 11 from the roof boards 38, hold the filter against the roof boards 38 and strengthen the ventilator member 11. As FIG. 5 illustrates, the flanges 52 preferably have an L-shaped cross-sectional configuration similar in shape to brace walls 46 where a portion of the cross-leg 48 has been omitted.

To install the ventilator member 11 with filter medium 18 attached thereto to the roof 14, the ventilator member 11 is positioned overlying and centered on the open ridge 12 as illustrated in FIG. 1. Next, to initially position and hold the ventilator member 11 against the roof 14, roofing nails (not illustrated) are inserted through the bushings 42 and driven into the roof boards 38. Thereafter, to secure the ventilator member 11 to the roof 14, a plurality of roofing nails (not illustrated) are driven through the ventilator member 11 at intervals along the nail line 44 illustrated in FIG. 5, between the brace walls 46, and into the roof boards 38. In order to provide a finished decorative look to the ventilator member 11 and finish the ventilator assembly 10 so that it blends into the remaining shingles 16, cap shingles **16*a* can be installed over the top of the ventilator member 11. The cap shingles 16*a* can be secured with separate roofing nails or with the same roofing nails used to secure the ventilator member 11 to the roof boards 38 along the nail line 44** as described above.

Modifications and variations of the present invention are possible in light of the above teachings. It is therefore to be understood that within the scope of the appended claims, the invention may be practiced otherwise than as specifically described.

I claim:

1. A roof ridge ventilator to be installed overlying the open ridge and along the length of the roof of a building which is adjustable to accommodate a variety of different roof pitches and directs the flow of air from the interior of the building to the exterior of the building comprising:

an elongate top wall member having a predetermined length and width and top and bottom sides;

a pair of outer side walls, one each integrally formed along the longitudinal length of and depending from a respective bottom side of said top wall member and at a predetermined angle with respect to said top wall member, each of said side walls including a plurality of apertures extending therethrough;

a pair of upturned edge members, one each integrally formed with a respective distal end of said outer side walls opposite said top wall member and extending along the longitudinal length of, and at a predetermined angle with respect to, said side walls, said upturned edge members extending toward said top wall member a predetermined distance to effectively shield at least a portion of said apertures; and a plurality of brace members positioned at predetermined intervals along the length of said bottom side of said top wall member for engagement with a roof surface.

2. The ventilator as defined in claim 1 wherein each of said upturned edge members includes a plurality of apertures therethrough proximate its base and the connection with said side walls, said apertures being spaced at predetermined intervals along the length of each edge member.

3. A roof ridge ventilator assembly to be installed overlying the open ridge and along the length of the roof of a building which is adjustable to accommodate a variety of different roof pitches and directs and filters the flow of air from the interior of the building to the exterior of the building, comprising:

an elongate filter medium having a predetermined length, width and thickness, said width selected to at least be slightly wider than the width of the open ridge;

an elongate ventilator member overlying and connected to said filter medium, said ventilator member having a predetermined length and width and top and bottom sides, being flexible in a lateral direction and formed by a top wall member, said top wall member having a width slightly less than said predetermined width of said ventilator member and being slightly bowed along its longitudinal center line to form a central bowed portion with first and second planar portions integrally connected on either longitudinal side of said bowed portion and with the concave side of said bowed portion being said bottom side and facing said filter medium, said first and second planar portions substantially being contained in first and second planes, respectively, that intersect above said ventilator member, said ventilator member including a pair of outer side walls, one each integrally formed with a respective first and second planar portion, said side walls extending along the longitudinal length of and depending from their respective first and second planar portions extending toward said filter medium, said side walls including a plurality of substantially parallel slots extending therethrough and along the entire longitudinal length of said side walls, distal outer ends of said side walls opposite respective first and second planar portions including an upturned edge which extends toward said first and second planar portions to a position proximate the respective planes containing said first and second planar portions; and a plurality of brace members positioned at predetermined intervals along the length of said bottom side of said first and second planar portions for supporting said ventilator member against said roof surface and trapping said filter medium therebetween.

4. The assembly as defined in claim 3 wherein each of said upturned edges includes a plurality of apertures therethrough proximate its base and the connection with said side walls, said apertures being spaced at predetermined intervals along the length of each edge member for drainage of water which may tend to accumulate between said upturned edges and said side walls.

5. The assembly as defined in claim 3 wherein each of said brace members is substantially T-shaped having a first stem member and a corresponding second top crossing member formed substantially perpendicular to one end of said first stem member, each of said first stem members lying against said underside of its respective first and second planar portion and extending outward away from said second top crossing member toward said side walls to form walls between said slots and terminating at the distal end of said side walls proximate the connection of said side walls with said upturned edges.

6. The assembly as defined in claim 5 wherein at least one of said first stem members of said T-shaped brace members includes a bushing member whose aperture extends through said side walls between consecutive slots for insertion of a nail therethrough to connect said ventilator member to said roof.

7. The assembly as defined in claim 3 wherein the interface between said central bowed portion and each of said first and second planar portions is formed with living hinges to facilitate bending movement therebetween.

8. The assembly as defined in claim 3 including a layer of shingles positioned overlying and connected to said top wall planar portions and said bowed portions.

* * * * *